United States Patent [19]

Chen

[11] 4,070,670

[45] Jan. 24, 1978

[54] AUTOMATIC SHUT-OFF AND ALARM FOR STOVE HEATING UNIT

[76] Inventor: Ho Chi Chen, No. 19, Chung Hsin Road, Sec. 1, San Chung City, Taipei, China /Taiwan

[21] Appl. No.: 653,763

[22] Filed: Jan. 30, 1976

[51] Int. Cl.[2] ..... G05B 9/00

[52] U.S. Cl. ..... 340/417; 340/244 R; 340/245; 219/506; 219/452; 219/509; 219/519; 126/42; 236/1 A; 236/20 A; 99/331; 99/344

[58] Field of Search ..... 340/417, 419, 235, 236, 340/238, 239 R, 242, 244 R, 244 C, 245 E; 219/487, 506, 285, 284, 443, 448, 451, 452, 453, 490, 507, 509, 519; 99/331, 344; 126/52, 39 G, 42; 236/1 A, 20 A

[56] References Cited

U.S. PATENT DOCUMENTS

| | | | |
|---|---|---|---|
| 2,747,176 | 5/1956 | Cox | 340/419 |
| 2,879,708 | 3/1959 | Cripe | 340/244 R |
| 3,069,671 | 12/1962 | Taylor | 340/244 |
| 3,200,388 | 8/1965 | Uhlig | 340/242 |
| 3,525,902 | 8/1970 | Davidson et al. | 200/61.04 X |
| 3,770,002 | 11/1973 | Brown | 200/61.05 |

*Primary Examiner*—John W. Caldwell, Sr.
*Assistant Examiner*—Donnie L. Crosland

[57] ABSTRACT

The invention relates to a safety control shut-off device for the heating element of a cooking stove. In one embodiment of this safety device, a burner plate of the stove is provided with several declining U-shaped grooves for collecting any spillage or overflow of water from the cooking operations. Water drops collected in the declining grooves are led through a discharge outlet, at the lowest portion of the grooves, and into a water drop detector located beneath the outlet, to complete an electrical circuit, which in turn will actuate and sound an alarm and will also actuate means for disconnecting the fuel source of the plate burner.

4 Claims, 9 Drawing Figures

AUTOMATIC SHUT-OFF AND ALARM FOR STOVE HEATING UNIT

BACKGROUND OF THE INVENTION

Gas, especially the liquefied propane gas, is widely used in our daily life for cooking purposes. However, the accidents causing loss of human lives and properties are always encountered. After analysing the accidental causes, it will be found that most of their reasons depend upon the continuous leaking of flammable gas. Whenever the burner flame is extinguished by the spillage of water overflowing from the cooking utensil on said burner, the unburned gas will be continuously emitted. The poisonous and uncolored gas may spread and accumulate in a space. If it meets any accidental spark, it will easily cause fire or explosion or it may cause asphyxiation of people. The present inventor has considered this dangerous phenomena, has developed the present safety device which will serve to save energy and prevent accidents.

SUMMARY OF THE INVENTION

The present invention is characterized in that a burner plate is formed with a series of declining U-shaped grooves for water flow use. The water flows through a drainage outlet, and then flows into the water drop detector in which a water switch is provided to connect the power source.

A solenoid valve is installed on the gas delivery line and is connected to the water drop detector switch. Upon closing of the water drop detector switch, the solenoid valve will be energized and the valve will close and shut off the supply of gas fuel.

The control circuit consists of a transformer step down the line voltage, a full-wave rectifier for rectifying the current, a capacitor for stabilizing or smoothing the current wave, and the water drop detector swtich. A relay is actuated by the switch and is connected to the paralleled alarm and solenoid so as to sound the alarm and close the valve.

The object of the present invention is to save the loss of gas and to prevent the happening of a dangerous accident.

If electric energy is used to energize the burner or heating element, the burner plate should take the form of an insulating plate having a heating coil. In this modification, the U-shaped grooves on the burner plate have also been provided with water drainage to lead water drops into the water drop detector which, in turn, actuates the control circuit.

DESCRIPTION OF THE PREFERRED EMBODIMENT

Figure 1:
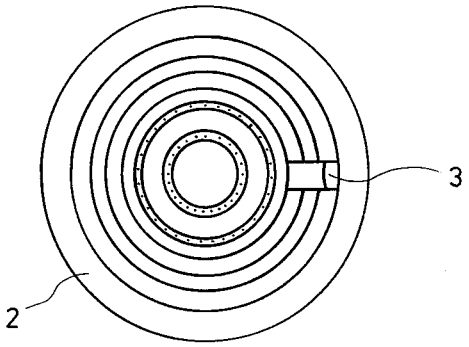
FIG. 1 is the top view of the burner plate of the preferred embodiment in accordance with the present invention.
Figure 2:
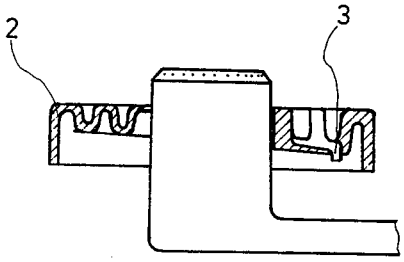
FIG. 2 is the side view of sectional drawing of FIG. 1.

As shown in FIGS. 1 and 2, a burner plate 2 formed with U-shaped grooves is mounted on burner equipment, such as a cooking range 1. The U-shaped grooves lead to a drainage port 3. A water drop detector is installed under the drain port 3. Two clamps 5 are clipped on said water drop detector 4 and serve as the positive and negative contacts of the electrical circuit.

Figure 3:
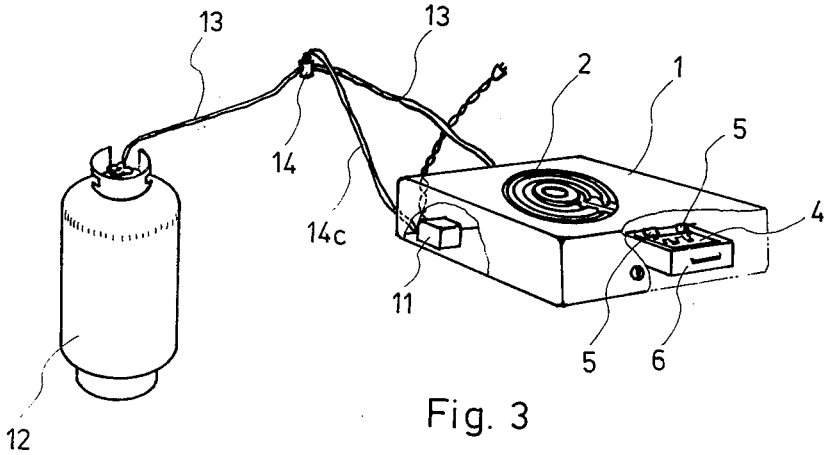
FIG. 3 is an illustrative drawing of the present invention.
Figure 4:
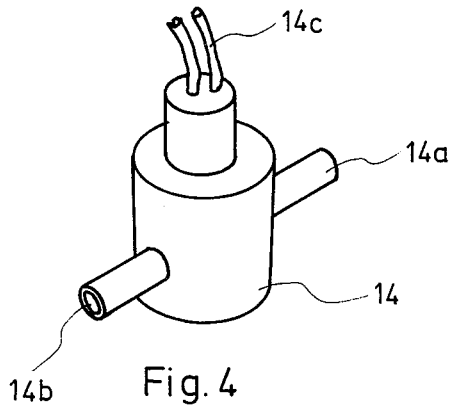
FIG. 4 is a solenoid valve illustration of the present invention.

A water drop container 6 is located under the water drop detector 4 so as to collect the spilled water. The said water drop container may be drawn in and out like a table drawer. As shown in FIG. 3, the electric parts except those clamps 5, e.g., transformer 7, capacitor 8, relay 9, and alarm 10, may be assembled in a box 11 made of heat resistant material which will be protected within the burner equipment.

The solenoid valve 14 is installed on gas delivery line 13 leading from gas cylinder 12. Said solenoid valve includes gas inlet connection 14*a* and gas outlet connection 14*b* and an electrical power line connection 14*c*. The solenoid is controlled by Relay 9. Gas inlet connection 14*a* is connected to gas cylinder 12 and will be closed whenever the solenoid is actuated by means of the control circuit.

When the spilled water passes into the U-shaped grooves on burner plate 2, the water will flow through drainage outlet 3 into the water drop detector 4 so as to close the control circuit and actuate the relay in order to actuate the alarm 10 and solenoid valve 14. The standard household voltage of 110 volts is stepped down to 9 volts through a transformer. The secondary current is rectified by the bridge type full-wave rectifier 15. Secondary rectified current is stabilized or smoothed out by capacitor 8, which in the present embodiment is rated 500 uf, 25 V. As the current passes through relay 9 and forms a closed circuit with water drop detector 4, not shown in FIG. 5, the direct current energizes the relay 9 which closes its related contacts, and connects alarm 10 and solenoid valve 14 to line voltage.

Figure 5:
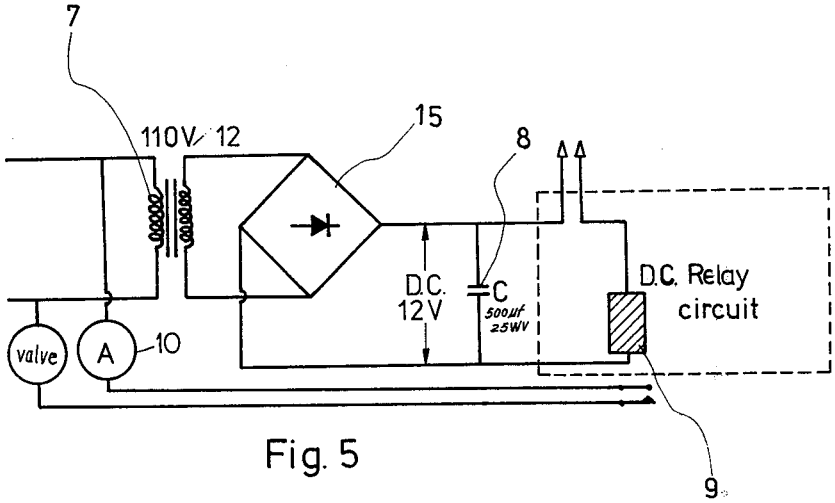
FIG. 5 is the electric circuit drawing in accordance with the present invention.

In FIG. 5 of the drawings, the alarm 10 and the solenoid valve 14 are shown connected in series with the relay contacts. The alarm and solenoid might just as well be connected in parallel with the supply source, this detail not constituting a critical aspect of this invention.

The circuit of FIG. 5 of the drawings shows a relay of a type operable on 12 volts D.C.

Figure 6:
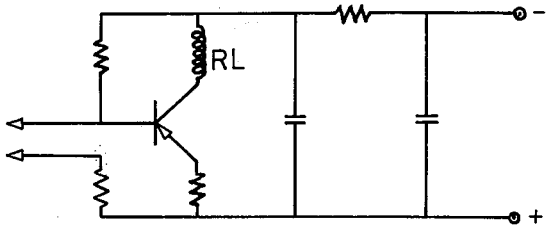
FIG. 6 is another optional drawing of the relay circuit of the present invention.

Another embodiment of a portion of the electrical circuit is shown in FIG. 6 of the drawings. In this embodiment, the transformer and rectifier are replaced by a transistor and voltage drop resistors and a filter network to provide energization of the relay.

Figure 8:
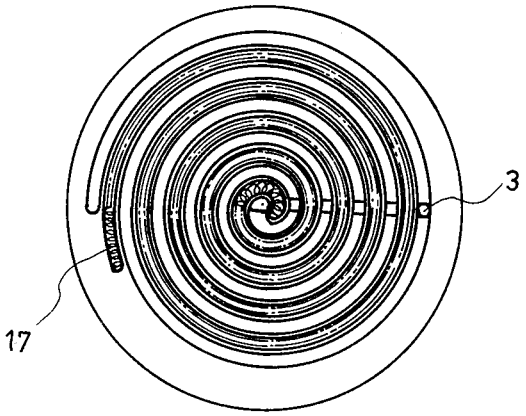
FIG. 8 is the top view drawing of the insulating plate and heating coil of another embodiment of this invention.
Figure 9:
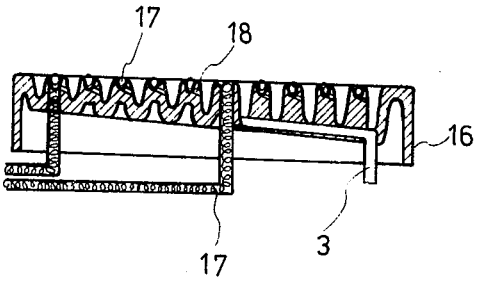
FIG. 9 is the sectional drawing of FIG. 8.

In the embodiment of the invention which uses electricity rather than gas to produce the heat for cooking, the insulating plate 16 and heating coil 17 are constructed and shown as FIGS. 8 and 9. The heating coil 17 is disposed within the U-shaped groove of the insulating plate.

Figure 7:
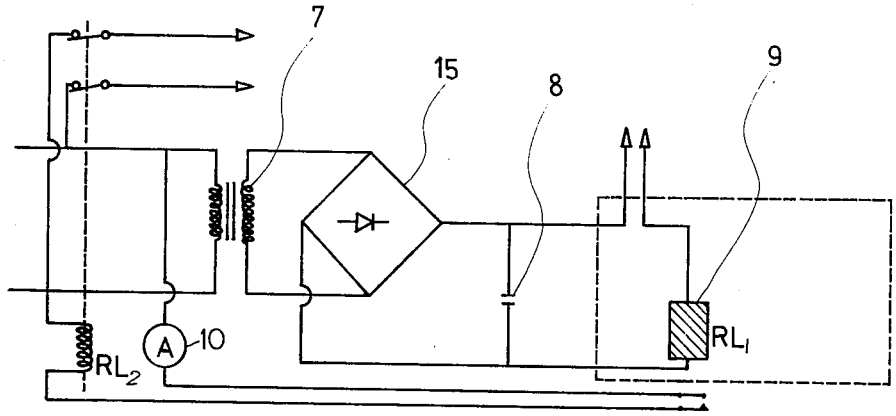
FIG. 7 is the electric circuit having transformed the electric energy into heat energy in accordance with the present invention.

Holes 18 are drilled at specific locations so as to collect the spilled water drops which, because of the pitched burner plate, accumulate and flow into the water drop detector to connect the control circuit. Having reference to FIG. 7, control relay $RL_1$ is actuated and energizes the alarm and line relay $RL_2$, which relay opens the line circuit to the burner or heater. Again, relay $RL_2$ and alarm A are shown connected in series, but can as well be connected in parallel.

I hereby claim:

1. A shut-off control device for a heating element of a cooking stove, comprising:

a plate having grooves and being pitched from a horizontal position; a heating element associated with said plate and connected to a source of energy;

a discharge outlet at an end portion of said grooves to allow discharge of spilled water collected in said grooves;

a water detector diposed beneath said outlet for collecting water discharged from said outlet and including electrical contacts which are connected to complete a circuit upon deposit of water therein;

a relay actuated by the closing of said electrical contacts in said water detector;

means operable in response to said relay to disconnect said heating element from said source of energy and means operable in response to said relay to sound an alarm.

2. A control device as claimed in claim 1 comprising an electrical supply circuit for energizing said relay, said supply circuit consisting of:

a step down transformer whose primary is connected to line voltage; and a rectifier connected to the secondary of said transformer in series with said relay coil and said water detector.

3. A control device as claimed in claim 1 wherein said heating element is a gas burner and said means to disconnect said heating element comprises a solenoid valve in a gas supply line to said burner.

4. A control device as claimed in claim 1 wherein said heating element is electrical and said means to disconnect said heating element comprises a relay having controlled contacts which disconnect the heating element from said source of energy.

* * * * *